US006999043B1

(12) United States Patent
Rivera

(10) Patent No.: US 6,999,043 B1
(45) Date of Patent: Feb. 14, 2006

(54) AMPHIBIOUS ANTENNAS FOR PROVIDING NEAR VERTICAL INCIDENCE SKYWAVE COMMUNICATION

(75) Inventor: David F. Rivera, Westerly, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/963,002

(22) Filed: Oct. 8, 2004

(51) Int. Cl.
*H01Q 1/36* (2006.01)

(52) U.S. Cl. ..... 343/895

(58) Field of Classification Search ..... 343/895
See application file for complete search history.

(56) References Cited

U.S. PATENT DOCUMENTS 3,413,512 A * 11/1968 Buck ..... 315/3.5
3,793,823 A * 2/1974 Tallman ..... 57/13
3,946,391 A * 3/1976 Cuckler et al. ..... 343/709
6,011,525 A 1/2000 Piole
6,014,107 A 1/2000 Wiesenfarth
6,293,835 B1 * 9/2001 Gorlov ..... 440/8
6,333,722 B1 12/2001 Kitano
6,338,812 B1 1/2002 Ogura
6,340,955 B1 1/2002 Chao
6,518,938 B1 * 2/2003 Chaoo ..... 343/895
6,603,433 B1 * 8/2003 Max et al. ..... 343/702

* cited by examiner

*Primary Examiner*—Tho Phan
(74) *Attorney, Agent, or Firm*—Michael P. Stanley; James M. Kasischke; Jean-Paul A. Nasser

(57) ABSTRACT

An amphibious antenna for providing Near Vertical Incidence Skywave (NVIS) communication when grounded to a conductive fluid. The amphibious antenna has a support member for supporting a helix. The helix includes a first helical arm that is not insulated and grounded, when in use, through a conductive fluid into which the antenna is placed, and a second helical arm that is insulated from the conductive fluid.

12 Claims, 1 Drawing Sheet

AMPHIBIOUS ANTENNAS FOR PROVIDING NEAR VERTICAL INCIDENCE SKYWAVE COMMUNICATION

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Technical Field of the Invention

The present invention relates to antennas and more particularly, to amphibious antennas for providing Near Vertical Incidence Skywave (NVIS) communication.

(2) Description of the Prior Art

Tactical communications in the frequency range of 2–30 MHz take advantage of ionospheric propagation effects to gather or disseminate intelligence over large distances. In the 2–12 MHz range, one mode of ionospheric propagation (i.e., Near Vertical Incidence Skywave (NVIS)) is used for distances shorter than long haul ionospheric skip (less than 800 km), but longer than the "radio horizon" distance at these frequencies (greater than 40 km).

Antennas used for NVIS communications are typically large resonant wire structures of various forms that include inverted Vees or horizontal dipole arrays. Depending on the frequency of operation, the beam patterns of these antennas are distinguished by a lobe that points directly over head (zenith) in order to affect NVIS mode communications.

There is a need for NVIS communication capabilities over sea as well as over land. Moreover, there is a need for an antenna structure that is collapsible, compact, and portable.

SUMMARY OF THE INVENTION

The present invention is a novel amphibious antenna for use in or over sea or on land. The antenna having a first helical arm that is insulated and a second helical arm that is un-insulated. The un-insulated helical arm providing a ground to a conductive fluid. The antenna provides Near Vertical Incidence Skywave (NVIS) communication as well as some line-of-sight capability over land or sea when connected to a suitable manpack transceiver. Further, when the second helical arm of the antenna is placed in or near a conducting interface, such as sea water, the electromagnetic boundary conditions are such that cancellation of the radiation fields at low angles, relative to the horizon, is minimized.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
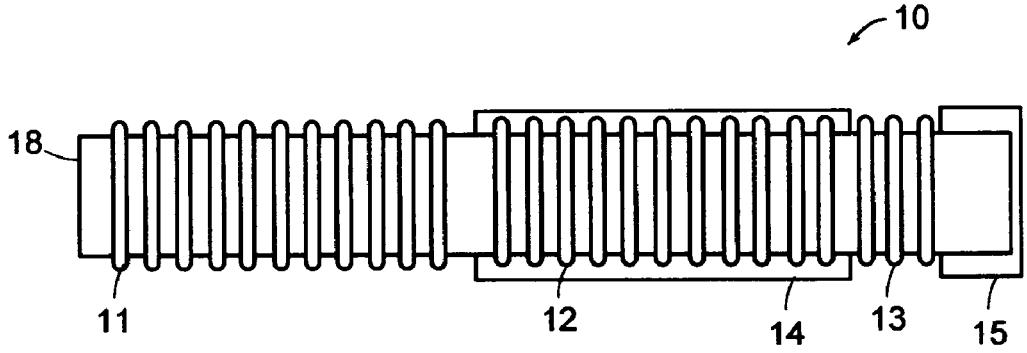
FIG. 1 is a side view of an antenna according to the present invention.

FIG. 1 is an antenna 10 having a hollow, insulating support member or core 18 for supporting helices 13 according to the present invention. The antenna 10 has at least two helical "arms" 11, 12. The first helical arm 11 is exposed and not insulated, while the second helical arm 12 is insulated by insulation 14. The insulation may be selected from any suitable material; however, in the preferred embodiment, fiberglass, or light weight plastic is used. The first helical arm 11 that is exposed is typically made from a conductive, non-corrosive metal, such as stainless steel. The second helical arm 12 may be made from a conductive material, that may be the same material as used for the first helical arm 11. However, because the second helical arm 12 is protected from corrosion by the insulation 14, the material chosen may not be non-corrosive, for example copper or brass.

The support member 18 of the antenna 10 is preferably constructed from a lightweight insulating material, such as plastic. In a preferred embodiment, the support member is approximately 12 inches in diameter and 10 to 12 feet in length. In the preferred embodiment, the helical arms 11, 12 are comprised of wide straps or ribbon shaped conductors instead of thin wire to allow enough surface for a good electrical connection to sea water, while simultaneously allowing for wide impedance bandwidth.

In use, a user places the antenna 10 in sea water. When the antenna 10 is deployed in sea water, the first helical arm 11 that is exposed and in contact with sea water provides the ground for the second helical arm or insulated portion 12 of the antenna 10.

When the antenna 10 is deployed over sea water, the first helical arm 11 that is exposed behaves as a grounding electrode for the second helical arm or insulated portion 12 of the antenna, allowing the antenna 10 to behave as a slow-wave transmission line antenna. The antenna is a slow-wave structure because the phase velocity along the axial direction of the antenna is smaller than the velocity in the direction occupied by the helical conductor; a function of a helical pitch angle. When the second helical arm 12 is placed in, on or near a conducting interface, such as sea water, the electromagnetic boundary conditions are such that cancellation of the radiation fields at low angles, relative to the horizon, is minimized. The second helical arm 12 formed by the connection to sea water has a broad beam pattern that extends over a considerable portion of the hemisphere, including zenith, permitting NVIS capability. The transmission lines for the antenna 10 (not shown) may be preferably attached to the first and second helical arms 11, 12 by running the lines through the support member 18 and drilling a hole through the support member 18 wherein the lines may be attached directly to the first and second helical arms 11, 12.

Figure 2:
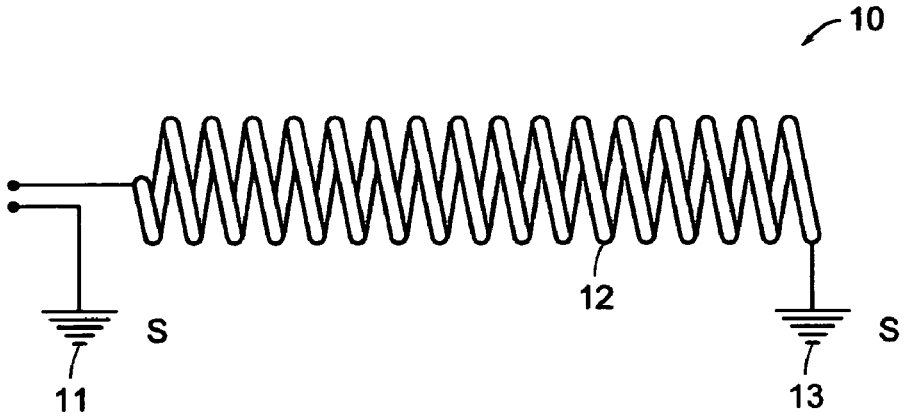
FIG. 2 is electrical schematic of the antenna shown in FIG. 1 showing one helical arm shorted to sea water and one insulated helical arm, wherein the insulation over the second helical arm is not shown.

FIG. 2 is an electrical schematic of an equivalent antenna over sea water of the antenna 10 shown in FIG. 1. The details for the antenna feed have been omitted for clarity. When the antenna 10 is used over land, the helical arms 11, 12 are open circuited, forming a slow-wave dipole antenna with a pattern similar to that of the grounded helical transmission line antenna. The resulting wide beam pattern in both modes (ungrounded and grounded) permits NVIS communication as well as some line-of-sight capability over land or sea.

Figure 3:
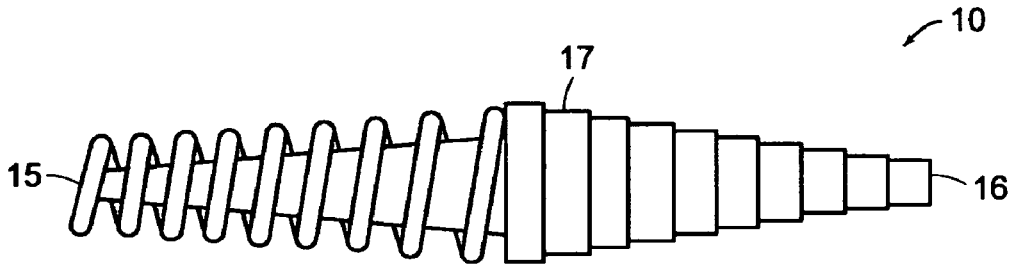
FIG. 3 is a collapsible antenna having a helix wherein the size of the exposed helix is exaggerated.

Referring to FIGS. 1 and 3 an alternative embodiment of the antenna 10, comprises the antenna 10 being collapsible in length. The support member 18 is made up of a series of non-conducting cylindrical shells 17 of varying size for mechanical support with mechanical stops (not shown) that keep the shells from coming apart. The helical arms 11, 12 are wound in the appropriate manner for its function (i.e., over the smaller diameter shells for support or within the larger shell assembly for insulation). When not in use, the antenna 10 is collapsible by pushing ends 15, 16 of the antenna 10 toward each other or by compressing the antenna 10 flat, like an accordion. When the antenna 10 is required for operation, the ends 15, 16 are moved away from each other or the antenna 10 is stretched open and manually deployed. In a preferred embodiment, the antenna 10 would comprise a length of about 15 feet when deployed and a length of approximately one-quarter to one-third of the deployed length when collapsed.

In summary, the antenna 10 according to the present invention is collapsible (in one embodiment), compact, lightweight, and manually deployed. The antenna 10 has dual mode (grounded and ungrounded).

The antenna 10 in the collapsible embodiment allows a user to carry the collapsed antenna 10 on his/her back. When the antenna 10 is needed for use, the user moves the ends 15, 16 of the antenna 10 away from each other, thereby manually deploying the antenna 10. In one embodiment, the antenna 10 is placed in seawater and powered up for use.

When the antenna 10 is needed but sea water is not available or when the antenna 10 cannot be submerged in sea water, the user moves the ends 15, 16 of the collapsed antenna 10 away from each other, thereby manually deploying the antenna 10. The antenna 10 is then used over land or sea water. The antenna 10 uses a slow-wave structure to enable performance over land and the sea. The antenna 10 is unique in that it uses exposed and insulated conducting arms or helical arms 11, 12 to affect a hybrid radiator for use over land or the sea.

After the antenna 10 is used in or over sea water, or over land, the antenna 10 is collapsible by pushing the ends 15, 16 of the antenna 10 toward each other or by compressing the antenna 10 flat. The antenna 10 is compacted into a flat package, which a user can easily carry.

In an alternative embodiment wherein portability is not required, the antenna 10 may be integrated directly into a sea-craft, such as a raft or Zodiac. The antenna 10 may be made part of a floatation collar. Further, the antenna 10 can be placed into sea water during use and retracted when not in use. Alternatively, the antenna 10 can be used over sea water. Modifications and substitutions by one of ordinary skill in the art are considered to be within the scope of the present invention, which is not to be limited except by the following claims.

What is claimed is:

1. An antenna for providing Near Vertical Incidence Skywave (NVIS) communication, comprising:

a support member, for supporting a helix;

a first helical arm of the helix, wherein the first helical arm is not insulated, forming a ground signal path when said first helical arm is disposed in a conductive fluid; and a second helical arm of the helix, said second helical arm covered by insulation for insulating the second helical arm from the first helical arm and the conductive fluid.

2. The antenna according to claim 1, wherein the support member is a lightweight, hollow insulating material.

3. The antenna according to claim 2, wherein the support member is plastic.

4. The antenna according to claim 1, wherein the first helical arm is made from a non-corrosive metal.

5. The antenna according to claim 4, wherein the first helical arm is made from stainless steel.

6. The antenna according to claim 5, wherein the second helical arm may be made from a metal selected from the group of copper and brass.

7. The antenna according to claim 4, wherein the second helical arm may be made from a metal different from the non-corrosive metal of the first helical arm.

8. The antenna according to claim 1, wherein the first helical arm and the second helical arm have circular cross-sections.

9. The antenna according to claim 1, wherein the first helical arm and the second helical arm are ribbon shaped.

10. The antenna according to claim 1, wherein the first helical arm and the second helical arm are open circuited, forming a slow-wave dipole antenna.

11. An antenna for providing Near Vertical Incidence Skywave (NVIS) communication, comprising:

a hollow, insulative support member, for supporting a helix;

a first helical arm of the helix, wherein the first helical arm is not insulated and is operatively connected, in use, to a conductive fluid providing a ground therebetween; and a second helical arm of the helix, said second helical arm covered by insulation for insulating the second helical arm from the first helical arm and the conductive fluid.

12. A collapsible antenna for providing Near Vertical Incidence Skywave (NVIS) communication having a length that is variable, comprising:

a hollow, insulative support member, for supporting a helix comprising a plurality of cylindrical shells of varying diameters, each shell having an axis in axial alignment with an adjacent shell and defining the length of the antenna when expanded, wherein some of the shells receive at least one adjacent shell, thereby housing the at least one adjacent shell when in a collapsed mode thereby reducing the length of the antenna;

a first helical arm of the helix, wherein the first helical arm is not insulated and is operatively connected, in use, to a conductive fluid providing a ground therebetween; and a second helical arm of the helix, said second helical arm covered by insulation for insulating the second helical arm from the first helical arm and the conductive fluid, wherein at least one of said plurality of shells serving comprises said insulation.

* * * * *